US006955196B2

(12) United States Patent
Giudici et al.

(10) Patent No.: US 6,955,196 B2
(45) Date of Patent: Oct. 18, 2005

(54) VACUUM INSULATED REFRIGERATOR CABINET AND METHOD FOR EVACUATING THE GAS-TIGHT INSULATED WALL THEREOF

(75) Inventors: Giorgio Giudici, Lonate Pozzolo (IT); David B. Kirby, St. Joseph, MI (US); Luigi Martinella, Ghiffa (IT); Beat D. Stocker, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 152 days.

(21) Appl. No.: 10/400,403

(22) Filed: Mar. 27, 2003

(65) Prior Publication Data

US 2003/0197017 A1 Oct. 23, 2003

(51) Int. Cl.[7] ..... B65B 1/20

(52) U.S. Cl. ..... 141/82; 141/65; 312/401; 62/269

(58) Field of Search ..... 141/63–65, 82; 62/268–270; 312/400, 401; 220/592.27, 592.09

(56) References Cited

U.S. PATENT DOCUMENTS

| | | | | |
|---|---|---|---|---|
| 3,130,561 A | | 4/1964 | Hnilicka | 62/331 |
| 5,934,085 A | * | 8/1999 | Suzuki et al. | 62/98 |
| 6,158,233 A | * | 12/2000 | Cohen et al. | 62/268 |
| 6,485,122 B2 | * | 11/2002 | Wolf et al. | 312/406.2 |

FOREIGN PATENT DOCUMENTS

| | | | |
|---|---|---|---|
| EP | 0633420 | 1/1995 | F16L 59/06 |

* cited by examiner

*Primary Examiner*—Timothy L. Maust
(74) *Attorney, Agent, or Firm*—Robert O. Rice; John F. Colligan; Stephen Krefman

(57) ABSTRACT

A vacuum insulated refrigerator cabinet comprises a substantially gas-tight container that is filled with a porous core and a gas absorber that communicates with said container and is filled with a gas adsorbent material. Between the container and the gas absorber there is provided a valve adapted to close the communication between the container and the gas absorber, and a heater is provided for heating the gas absorber in order to evacuate gases when the valve is closed.

5 Claims, 1 Drawing Sheet

VACUUM INSULATED REFRIGERATOR CABINET AND METHOD FOR EVACUATING THE GAS-TIGHT INSULATED WALL THEREOF

BACKGROUND OF THE INVENTION

1. Field of the Invention

The present invention relates to a vacuum insulated refrigerator cabinet comprising a substantially gas-tight container that is filled with a substantially porous core and a gas-storage container that communicates with said container and is filled with a gas adsorbent material. A vacuum insulated refrigerator cabinet of this kind is disclosed by EP-A-860669.

With the term "refrigerator" we mean every kind of domestic appliance in which the inside temperature is lower than room temperature, i.e. domestic refrigerators, vertical freezers, chest freezer or the like.

2. Description of the Related Art

The good insulation-capabilities of different vacuum-insulation materials (fibre, foam or powder-based) are well known in the field of refrigeration and have been improved significantly in the last decade. Despite of these improvements and the increasing demand for reduced electricity consumption, an industrial production of vacuum-insulated refrigerators for domestic private use has not been started yet, although much development work has been invested.

The main problem is to sustain the vacuum for times of 10–15 years (usual life of a domestic appliance) without increasing too much the production cost of the product. While the traditional method, which consists in welding "vacuum-tight" structures (mostly of stainless steel), is very expensive (both in process and especially in material cost aspects), the refrigerator cabinets produced with the more cost-effective system which makes use of plastic liners (with or without anti-diffusion claddings) have a limited lifetime and therefore they are not yet in production. The solution disclosed in the above mentioned EP-A-860669 does not mostly guarantee low-pressure levels in the gas-tight container for substantially the entire life of the refrigerator. The alternative solution of providing a refrigerator with a vacuum pump running almost continuously, as shown in EP-A-587546, does increase too much the overall energy consumption of the refrigerator (in other words what it is saved in terms of decrease of heat transfer through the wall of the refrigerator is lost in running the vacuum pump). Such known way to maintain a vacuum in the wall of a refrigerator cabinet uses a pump to periodically recover the required vacuum that may be degraded by permeation of gasses and water vapor. Small, low cost mechanical pumps will not be able to reach the vacuum levels required to achieve acceptable insulating values. Small, low cost, mechanical pumps can evacuate down to a range of 20 to 200 mbar quite rapidly. However, most vacuum insulation fillers require vacuums below this range. Some open celled foam fillers require a vacuum lower than 0.1 mbar to reach the kind of thermal conductivities desired.

SUMMARY OF THE INVENTION

An object of this invention is to provide a refrigerator cabinet of the above type that widely maintains the low-pressure level and therefore insulation performance of metal structures, but with a significant reduction of the overall cost of the appliance. Moreover such good results are obtained with a decrease of the overall energy consumption of the appliance.

The present invention, as defined in the attached claims, discloses how to maintain the low pressure and vacuum-tightness with a suitable design and cost-effective evacuation method.

According to the present invention, a vacuum insulated cabinet for a refrigerator can cut energy costs significantly. According to a first embodiment of the present invention a design of a new evacuating system is provided that can achieve the desired levels of vacuum without expending excessive energy. To reach the lower pressures, such embodiment uses an adsorption stage where a gas-storage container is used which is connected, on one side, to the insulation and, on the other side, to the atmosphere. Automatic valve means are provided which can close/open the passage between the adsorption stage and the insulation, and between the adsorption stage and the atmosphere respectively, according to a predetermined cycle.

According to a second embodiment of the invention a multiple stage evacuation system is used, where a portion of the evacuating system downstream the gas-storage container may be a mechanical stage or a second auxiliary adsorption stage. In the first case the adsorption stage is connected in series with a mechanical pump such that the two can develop the required vacuum in an additive method. It is advantageous to connect the gas-storage container immediately to the insulation filler. In this way, the adsorption stage will "pump" the insulation filler almost continuously and will not require additional energy. The cycle of the adsorption stage is completed by heating it to a temperature where it produces a pressure above the minimum usable intake pressure of the mechanical pump. The gas-storage container of the adsorption stage can be as simple as a cylinder filled with physical absorbents such as molecular sieves, silica gel, active carbon, aluminas, aluminosilicates, and other absorbents of the same type.

The mechanical pump stage will start pumping when the pressure from the heated adsorption stage reaches the minimum usable intake pressure of the mechanical pump. The mechanical pump will evacuate the adsorption stage to remove most of the gas (air, water vapor, etc.) that was previously adsorbed by gas-storage container. The refrigerator cabinet will be designed such that the mechanical pumping stage will be rarely used, so as to use as little energy as possible.

When a second adsorption stage is used instead of the mechanical vacuum pump, both portions of the evacuation system are physical adsorption stages in series. Together with adsorbing materials in the gas-storage containers where the adsorption/desorption stage is carried out, it is possible to use chemical adsorbents such as CaO (used to adsorb water). These chemical adsorbents can be mixed with physical adsorbents for adsorbing residual gases (water vapor, hydrogen). Even if the sorption on chemical getters is practically irreversible, nevertheless their use can guarantee a better performance in term of vacuum level inside the gas-tight container.

BRIEF DESCRIPTION OF THE DRAWINGS

The invention will now be explained in greater detail with reference to drawings, which show.

DETAILED DESCRIPTION

Figure 1:
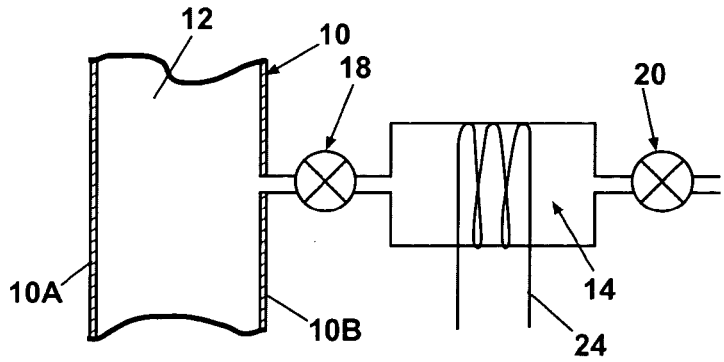
FIG. 1 is a schematic view of a portion of a vacuum insulated refrigerator cabinet according to a first embodiment of the present invention.

With reference to FIG. 1, a refrigerator cabinet comprises a insulated double wall 10 comprising two relatively gas impervious walls 10*a* and 10*b* filled with an insulation material 12 that can be evacuated. The insulation material 12 can be an inorganic powder such as silica and alumina, inorganic and organic fibers, an injection foamed object of open-cell or semi-open-cell structure such as polyurethane foam, or a open celled polystyrene foam that is extruded as a board and assembled into the cabinet. The insulation material 12 is connected to a gas-storage container 14 in which an adsorption stage is performed. Isolation valves 18 and 20 will be placed between the cabinet and adsorption stage 14 and between the adsorption stage 14 and the atmosphere respectively. During a majority of the time of refrigerator operation, only valve 18 will remain open, in order to continuously evacuate the cabinet insulation 12. When the performance of the insulation is lower than a predetermined level (measured for instance through a measure/evaluation of thermal conductivity, pressure or "pull down time", i.e. the time in which the temperature inside the refrigerator cabinet decreases or increases up to a predetermined value following the switching off or switching on of the compressor respectively), which indicates that its pressure is too high, valve 18 closes and a heater 24 for the adsorption stage 14 is activated. When the interior pressure of the heated adsorption stage 14 surpasses atmospheric pressure, valve 20 is opened. The heating continues until it has exhausted most of the adsorbed air and water vapor from the adsorption stage 14. At this point valve 20 closes, the heater 24 of the adsorption stage 14 is turned off, and valve 18 is reopened. The cycle then restarts when the vacuum level in the double wall 10 is no longer satisfactory in terms of insulation properties.

According to a second embodiment of the invention (shown in FIG. 2), in which the same reference numerals of FIG. 1 are used for indicating identical or similar elements, the gas-storage container 14 is also connected to a mechanical vacuum pump 16 which is controlled by the electronic control of the refrigerator (not shown).

In this embodiment the isolation valve 20 is placed between the adsorption stage 14 and the mechanical pump 16. An optional valve 22 can be inserted between the mechanical pump stage 16 and the ambient atmosphere. During a majority of the time of refrigerator operation, only valve 18 will remain open, in order to continuously evacuate the cabinet insulation 12. When the insulation reaches a low performance in term of thermal conductivity, which indicates that its pressure is too high, valve 18 closes and the heater 24 for the adsorption stage 14 is activated. When interior pressure of the adsorption stage 14 reaches the point that the mechanical pump 16 can evacuate it, then the valve 20 is opened and the vacuum pump 16 is activated. The vacuum pump 16 continues until it has exhausted most of the adsorbed air, water vapor and other gases from the adsorption stage 14. At this point, the adsorption stage 14 is turned off, valve 20 closes, the pump is stopped and valve 18 is reopened. The cycle then restarts when the thermal conductivity level in the wall 10 is higher than a predetermined value. All valves 18, 20 and 22 together with the motor of the vacuum pump 16 are linked to the electronic control unit of the refrigerator, which is also linked to a sensor (not shown) for detecting when the cycle has to be restarted. The arrangement of the vacuum pump 16 downstream the adsorption stage 14 does not require the use of special pumps for very low operating pressure ranges, therefore reducing the overall cost of the appliance.

Figure 3:
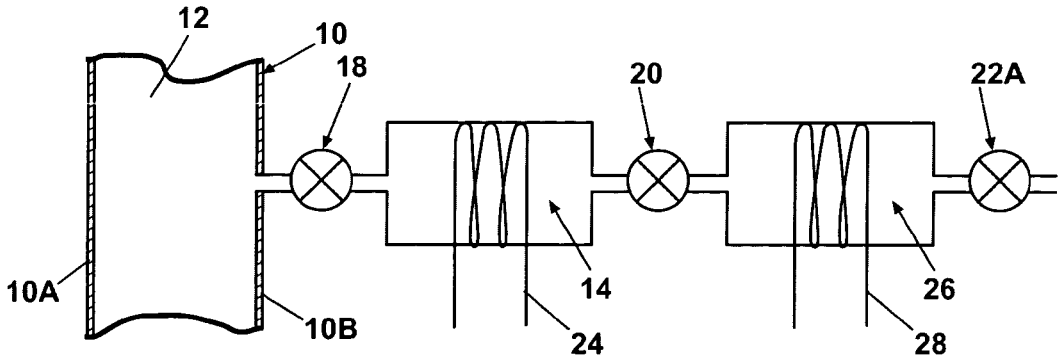
FIG. 3 is a view similar to FIG. 2 that shows a different version of the second embodiment of the present invention.

According to a different version of the second embodiment as shown in FIG. 3, the advantages of two stages in series are obtained without the use of a vacuum pump. As a matter of fact it is well known that these small vacuum pumps are prone to failure and can be quite noisy. The embodiment shown in FIG. 3 of the present invention makes use of physical chemical two stages evacuation system that can achieve the desired levels of vacuum without the disadvantages of mechanical pumps.

Figure 2:
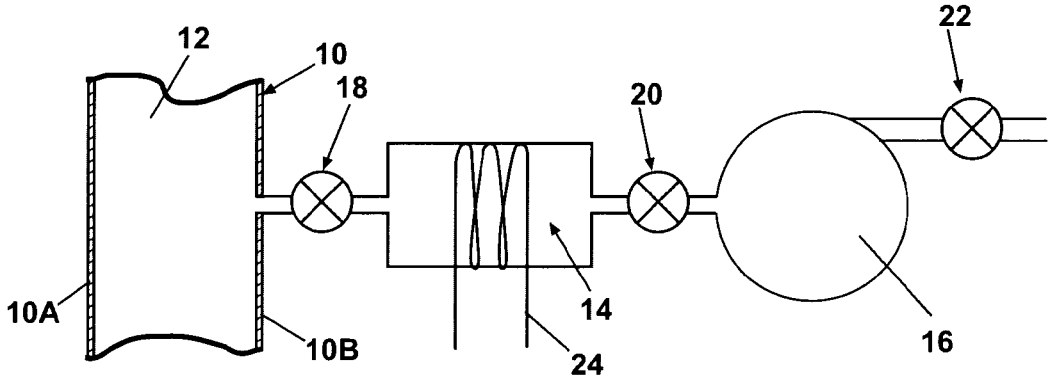
FIG. 2 is a view similar to FIG. 1 which shows a second embodiment of the present invention.

With reference to FIG. 3 (where the same reference numerals of FIG. 2 are used for indicating identical or similar components), the mechanical vacuum pump downstream the gas-storage container 14 is replaced by an auxiliary gas-storage container 26 filled with physical adsorbent. The function of the system is quite similar to the first embodiment, where two adsorption stages are connected in series instead of one stage only. Air, water vapor and other gases are first absorbed at low pressures in the gas-storage container 14 and then intermittently evacuated into the similar auxiliary gas-storage container 26, which operates in a higher pressure range and can be easily exhausted to atmospheric pressure. The advantage of this system, compared to the first embodiment in which only one adsorption stage is used, is that much lower temperatures can be used for regeneration of the adsorbing material. Also in this embodiment isolation valves are placed between the cabinet and adsorption stage 14 (valve 18), between the adsorption stage 14 and auxiliary adsorption stage 26 (valve 20), and between the auxiliary adsorption stage 26 and the ambient atmosphere (valve 22*a*). The valve 22*a* is needed to prevent re-adsorption of air and moisture from the ambient when the heater 28 is turned off and the gas-storage container or absorber 26 is allowed to cool. During a majority of the time of refrigerator operation valve 18 will remain open, in order to continuously evacuate the cabinet insulation. When the insulation 12 reaches a thermal conductivity, which indicates that its pressure is too high, valve 18 closes and the heater 24 for adsorption stage 14 is activated. When the interior pressure of adsorption stage 14 reaches the point that auxiliary adsorption stage 26 can evacuate it, then the valve 20 is opened. The cool auxiliary adsorption stage 26 continues until it has exhausted most of the air and water vapor from the heated adsorption stage 14. At this point, the heater 24 of the adsorption stage 14 is turned off, valve 20 closes and valve 18 is reopened. The cycle continues by opening valve 22*a*, heating auxiliary stage 26 by means of a heater 28 until it is exhausted of air, water vapor and other residual gases through valve 22*a*. Valve 22*a* is then closed to prevent re-adsorption of air and water vapor from the atmosphere.

Of course it would be possible to use more than two adsorption stages arranged in series, these solutions being within the scope of the present invention.

We claim:

1. A vacuum insulated refrigerator cabinet comprising a pair of walls that form a substantially gas-tight container being filled with an insulation material, and a gas-storage container in communication with the container and being filled with a gas absorbent material, wherein between the container and the gas-storage container there is provided a valve adapted to close the communication between the container and the gas-storage container, and in that a heater is provided for heating the gas-storage container in order to evacuate gases when the valve is closed, and wherein the gas-storage container communicates, through a second valve, with a vacuum pump adapted to assist the evacuation of the gas-storage container.

2. The vacuum insulated refrigerator cabinet according to claim 1, wherein the gas-storage container communicates, through a second valve, with an auxiliary gas-storage container adapted to assist the evacuation of the gas-storage container.

3. The vacuum insulated refrigerator cabinet according to claim 2, wherein the auxiliary gas-storage container is provided with an auxiliary heater.

4. The vacuum insulated refrigerator cabinet according to claim 2, wherein the auxiliary gas-storage container communicates with the atmosphere through a third valve.

5. The vacuum insulated refrigerator cabinet according to claim 1, wherein the valve and heater are connected to a central processing unit of the refrigerator cabinet for performing a predetermined cycle.

* * * * *